United States Patent [19]

Krantz

[11] 4,431,251

[45] Feb. 14, 1984

[54] ELECTRICAL CONNECTOR WITH A BUILT IN CIRCUIT PROTECTION DEVICE

[75] Inventor: Leonard A. Krantz, Sidney, N.Y.

[73] Assignee: The Bendix Corporation, Southfield, Mich.

[21] Appl. No.: 310,692

[22] Filed: Oct. 13, 1981

[51] Int. Cl.[3] ..... H01R 13/66

[52] U.S. Cl. ..... 339/143 R; 339/147 R

[58] Field of Search ..... 339/143, 147; 333/185

[56] References Cited

U.S. PATENT DOCUMENTS

| | | | |
|---|---|---|---|
| 3,790,858 | 2/1974 | Brancaleone | 317/99 |
| 4,173,745 | 11/1979 | Saunders | 333/185 X |
| 4,264,116 | 4/1981 | Gliha | 339/147 R X |
| 4,268,105 | 5/1981 | Widmayer et al. | 333/185 X |

*Primary Examiner*—Eugene F. Desmond

*Attorney, Agent, or Firm*—John R. Benefiel; Raymond J. Eifler

[57] ABSTRACT

An electrical connector (10) having built-in rapid response solid state circuit protection devices (42) for the absorption of electromagnetic pulses and the like associated with the connector contacts (16) by grounding to the connector shell (22), the circuit protection devices (42) mounted between a ground plate (44) and an insert disc (52) which carries an electrical connection to the respective contact (16). In some embodiments leads (48, 50) of the device (42) are connected into the connector (10), while in the other embodiments the diodes (156) are directly mounted to the ground plate (150) and disc (152). All connections are soldered to minimize the inductance created by the connections to minimize the response time and accurately control the voltage level triggering the devices. (FIG. 1)

7 Claims, 5 Drawing Figures

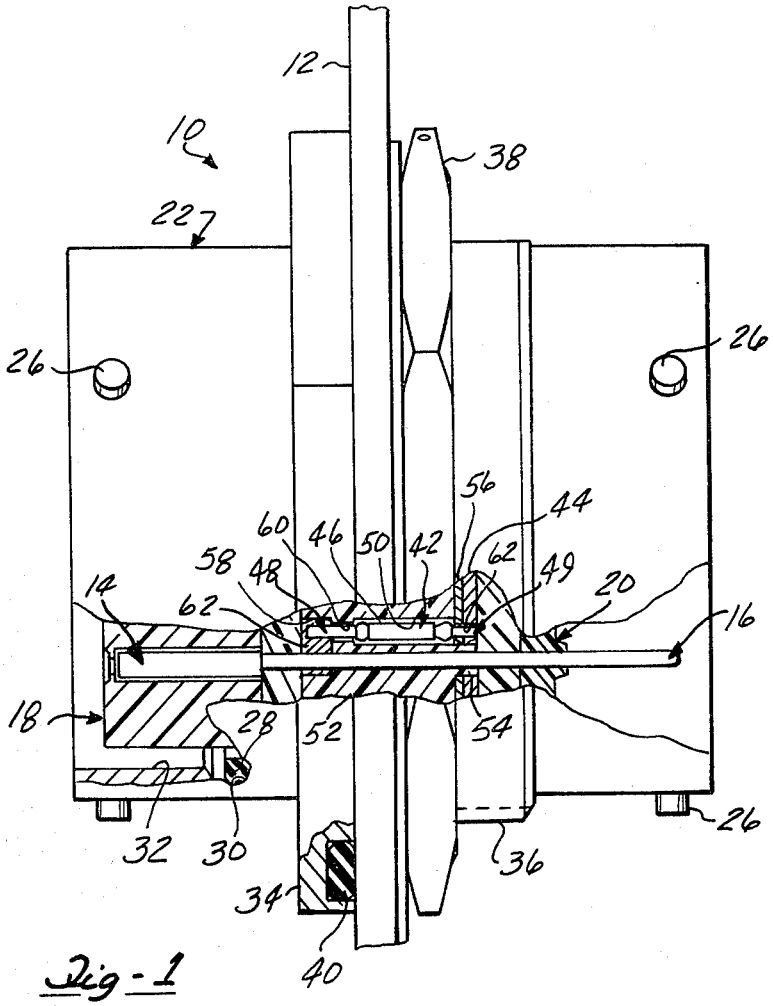
Fig-1
Fig-4
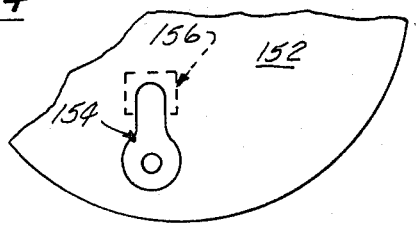

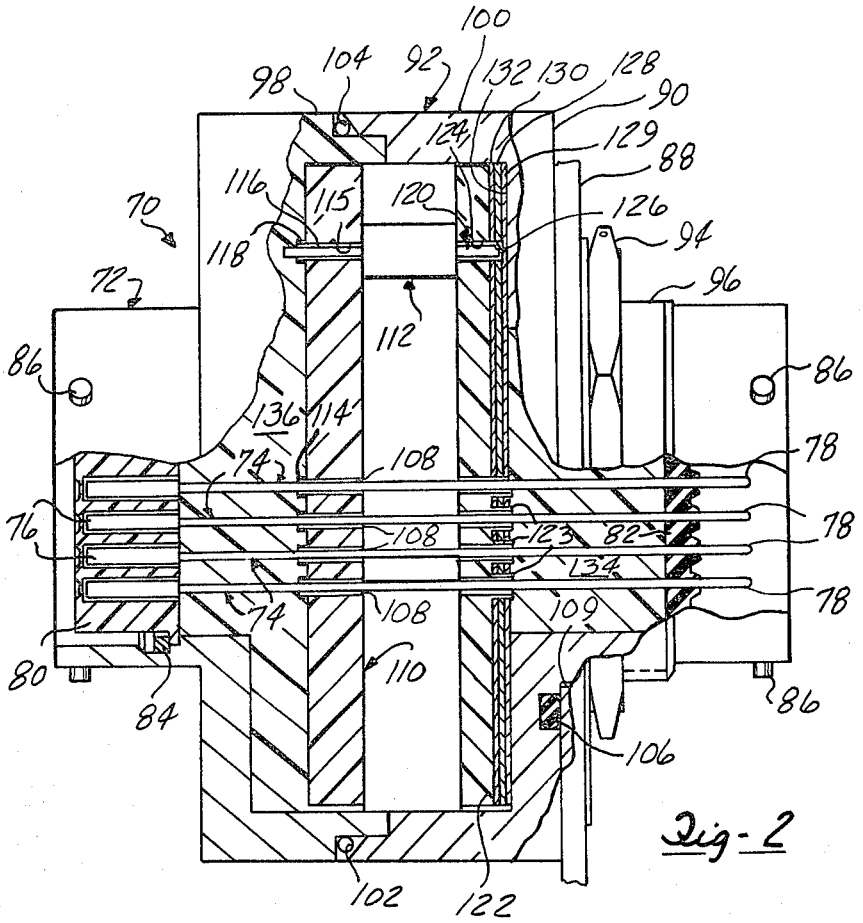
Fig-2
Fig-3
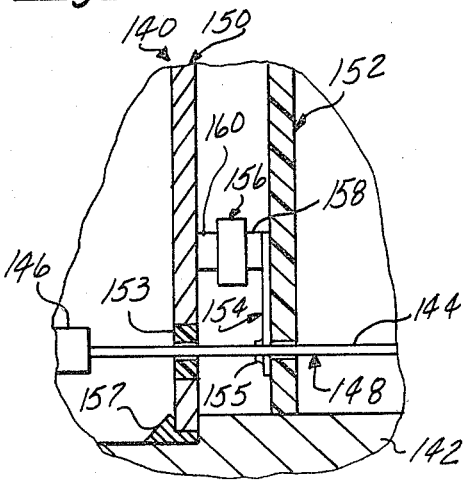
Fig-5
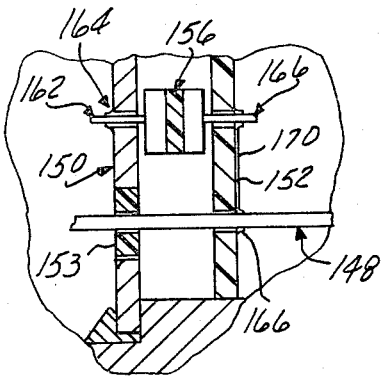

ELECTRICAL CONNECTOR WITH A BUILT IN CIRCUIT PROTECTION DEVICE

This invention relates to electrical connectors and more particularly to electrical connectors having built in devices providing current surge protection for circuits to which the connector contacts are electrically connected.

Solid state circuitry as has been developed in modern electronics is often extremely sensitive to spurious electrical phenomenon such as static electricity, RF "hash", and electromagnetic pulses (EMP). Protection against RF "hash" and other transient signals has been satisfactorily afforded in the past by filter elements integrated with the electrical connector which include a grounding electrode connected to a ground plate such that the RF surge is conducted to the connector shell, which in turn is grounded.

Static electricity also produces the so-called "triboelectric" effect which can cause failure in sensitive solid state circuits.

In addition there also sometimes occurs the so-called "electromagnetic pulse" phenomenon (EMP) caused by nuclear explosions producing a high concentration of ions, which in turn can collect electrons to create a current surge in the conductors.

Both the triboelectric and EMP current surges occur with extreme rapidity, i.e., failure of the circuit can occur within a matter of a few nanoseconds, and conventional circuit protection devices such as zener diodes cannot react with sufficient speed to prevent the circuit failure.

An additional related effect is self inductance, in which the EMP voltage build up is of such extreme rapidity that, a conductor will itself act as an inductance which results in a lag in the voltage buildup from one end of the conductor to the other. This effect delays the response time of a connected protective device to such current surges, aggravating the problem.

There have heretofore been developed rapid response devices which have been employed to protect highly sensitive solid state circuits against such extremely short duration transients.

Such devices have been commonly incorporated into the circuit by wiring the device into the circuit PC board. As noted, the self-inductance phenomenon may retard the response time of the device by this arrangement, such as to seriously compromise the protection afforded the circuitry.

There has heretofore been proposed, in U.S. Pat. No. 3,790,858 issued Feb. 5, 1974, entitled "Electrical Connector with Component Grounding Plate" that such circuit protection devices be incorporated into the connector associated with the circuit. However, the approach taken in that patent relies on a mechanical spring finger connection of a grounding plate carrying the circuit protection devices and the connector shell, and a similar spring finger connection between the grounding plate, and an outside case enclosing each circuit protection device, the case acting as the electrical connection to one side of the diode.

This approach also introduces substantial inductive impedance at each juncture, adversely affecting the response time and trigger voltage level of the device in conducting the current to a ground, i.e. to the connector shell.

Also, the connection of one side of the diode to the case of each device appears to be impractical, due to the crystal wafer section nature of such diodes as are currently available for these applications.

Also, the bulk of such protective devices has contributed, in some installations, to excessive bulk of a so-equipped the connector.

Finally, current surges resulting from these phenomena can be quite high, although of extremely short duration, such that heat build up in the device can seriously affect the capability of the device to conduct such currents to ground, if the installation does not allow rapid dissipation of the heat.

DISCLOSURE OF THE INVENTION

The present invention achieves circuit protection in those applications which the circuit is associated with an electrical connector by incorporating the protection device to be built into the connector in such a manner as to minimize the self-inductance phenomenon. This is achieved by providing a grounding plate and circuit connections to the connector contacts between which the protective devices are sandwiched, with one side of the device solder connected to the ground plate, and the other side soldered to the electrical connections to thus provide minimum lead lengths and a compact installation. The solder connection eliminates the self inductance effect of the mechanical connections heretofore proposed.

In one embodiment the protective device has oppositely extending leads previously assembled thereto, and each device is carried in an axial bore formed in an insert disc, with a lead on one side being received into a recess on one side of the insert disc, and a soldered connection being made to an associated connector contact also extending through the recess. The opposite lead is received in an opening in a conductive grounding plate and solder connected thereto, with the grounding plate being soldered to be electrically connected to the connector shell body. In this embodiment, each of the protective devices extends immediately along side and parallel to the associated contact.

In other embodiments, the circuit protection devices are sandwiched between an insert carrying the connections to the respective contacts, and the grounding plate.

In one of the other embodiments, the circuit protection devices also carry leads and are arranged radially outward from the connector contacts with the suitable connections via a PC board between a respective protective device and its associated contact.

In another of the other embodiments, a protective diode is directly sandwiched between the grounding plate and a support disc with a soldered connection therebetween on either side.

In a last described embodiment the diode is electrically and mechanically supported with nail head terminals in turn supported by the respective ground plate and support disc.

Each embodiment has the advantage of a compact, simple packaging of the circuit protection device, with short lead lengths, and all-soldered electrical connections to maximize the response time of the device.

In addition, the ground plate acts as a heat sink conducting the heat generated by the current surge to the connector shell and the mounting structure, such that heat dissipation is also maximized to further enhance the performance of the device.

DETAILED DESCRIPTION OF THE INVENTION

FIG. 1 is a view in partial longitudinal section of an electrical connector incorporating a circuit protection device according to the present invention with a fragmentary view of a mounting bulkhead.

FIG. 2 is a view in partial longitudinal section of an electrical connector according to another embodiment of the present invention.

FIG. 3 is a fragmentary longitudinal sectional view of an electrical connector depicting another embodiment of the invention shown in FIG. 2.

FIG. 4 is an endwise fragmentary view of a support disc incorporated in the connector shown in FIG. 3.

FIG. 5 is a fragmentary longitudinal sectional view of another embodiment of a connector according to the present invention.

Referring to FIG. 1, an electrical connector 10 is depicted which is adapted for a through bulkhead installation, in which it is mounted to a panel 12, with electrical connections made with mating electrical connectors (not shown) installed on either side. Socket contacts 14 are integral with pin contacts 16, only one shown as representative in FIG. 1, but each disposed at either end of the connector 10. The socket contacts 14 are mounted in a socket insert 18 of suitable electrically insulating material, while the pin contacts 16 are mounted in a combined insert-gasket 20, all of which are mounted in the interior of a connector shell 22 of a metallic or other conductive material. A mating connector (not shown) is adapted to be received within the shell 22 in order to make contact with the socket contacts 14 and similarly at the other end with the pin contacts 16.

Suitable bayonet connections are employed in order to secure the mechanical connection of the mating components thereto which includes bayonet projections 26 at either end of the connector shell 22 acting to cooperate with slots in the manner well known to those skilled in the art. A suitable seal 28 is disposed in a seal recess 30 formed on the interior bore 32 of one end of the connector shell 22 in order to provide sealing of the mating component portion moving into the clearance space between the socket insert 18 and the shell bore 32. A similar seal (not shown) is installed on the other side of the connector.

At the other end of the connector 10, seal 20 performs an interfacial sealing function in addition to the insulating support of the pin contacts 16.

The electrical connector 10 is mounted by means of a flange 34 engaging the panel 12, with a threaded exterior portion 36 of the connector shell 22 projecting through an opening in the panel. A nut 38 threadably engages the exterior thread and is adapted to draw the flange 34 into secure engagement with the panel 12. A suitable packing 40 is provided in order to seal the panel 12 and flange 34.

According to the concept of the present invention, a rapid response circuit protection device is directly associated with each of the contacts 16 which are signal carrying, i.e., those contacts which are not themselves directly grounded to the connector shell 22. The installation of a typical contact 16 and associated circuit protection device 42 is shown in FIG. 1, in which circuit protection device 42 is electrically connected on one side to the contact 16 and the other side to a ground plate 44. The ground plate 44 is electrically connected to the connector shell 22 such that upon occurrence of a spurious voltage at a predetermined minimum level designed into the circuit protection device 42, the contact is directly grounded to the connector shell 22, and thus to the panel 12.

A suitable rapid response circuit protection device is marketed by General Semiconductor under the trade name "Transzorb", which has a response time on the order of several nanoseconds. These devices are similar in function to a zener diode, except having a much more rapid response time, i.e., upon achievement of a designed in voltage, the diode becomes conductive, enabling the grounding out of relatively high voltage transients such as occur upon the incidence of an electromagnetic pulse as described above.

Such components typically are supplied with prewired connections including a general elongated housing 46, with external leads 48 and 49 extending from opposite ends, such that each is provided with means for electrical connection into the connection.

Each circuit protection device 42 is received within a bore 50 formed into a mounting insert 52, of plastic or other electrically insulating material.

Pin contacts 16 pass through openings formed into the insert 52, and the insert 52 further is formed with a protuberance 54 associated with each pin contact 16 which extends through the ground plate 44 and a layer of soldering metal 56 immediately adjacent to the ground plate 44. Thus the pin contact 16 is physically supported intermediate its length by the insert 52 and is electrically insulated from the ground plate 44 by the protuberances 54.

The mounting insert 52 is also formed with an array of lesser diameter recesses 58, into each of which the end of one of the pin connection 48 of each circuit protection device 42 protrudes, with each pin connection 48 also being received in a short smaller diameter opening 60 separating the recess 58 from the bore 50. Each pin contact 16 associated with the particular protection device 42 passes through the same recess 58, such that a quantity of solder 62 disposed in the recess establishes a reliable electrical connection therebetween, without introducing an inductance to the circuit path.

Each of the other circuit protection devices 42 is received in a respective suitable opening 64 formed in the ground plate 44. A solder preform layer 56 is provided to secure an electrical connection thereto. The grounding plate is also soldered to the shell 22 for the same reason. Accordingly, the circuit protection devices 42 are mounted between the ground plate 44 and the connection to the pin contact 16, disposed extending parallel to and immediately along side a segment of the pin contact 16 and intermediate the spaces between the contacts 16 carried by connector 10 to provide a very compact mounting thereof which does not substantially increase the bulk of the connector 10.

At the same time the electrical connections are of minimum length and soldered to reduce the self-inductance effect described above. The ground plate 44 and a layer of solder 56 acts as a heat sink so that heat generated by the current surge is carried away from the device to increase its load carrying capacity. The mass of the connector shell 22 and panel 12 is utilized in conjunction therewith to function as a very effective heat sink in addition to the mass of the ground plate 44 itself.

The load carrying capacity of the circuit protection devices 42 vary with the size of the device. Accordingly, for designs which are intended to accomodate relatively heavy current surges, it may not be possible to mount these devices between and directly along side each pin contact 16.

FIG. 2 illustrates a second embodiment of a connector 70 having a generally cylindrical metal shell 72, which, in conventional fashion houses an array of contacts 74 formed with a socket section 76 and a pin section 78, each disposed at either end of the connector shell 72 for connection with mating plug and jack connectors respectively in the manner well known in the art. The socket contacts 76 are housed in an electrically insulating insert 80 mounted within the connector shell 72 as shown while the pin contact sections pass through a combination gasket-insert 82 housed in the other end of the connector shell 72, each having suitable corresponding openings. A seal 84 serves to mate with the receptacle connector component and a similar seal (not shown) is also provided on the other side, whereas the face of the sealing insert 82 provides a suitable interfacial seal with the mating plug connector component (not shown). Projections 86 are provided at either end for a suitable bayonet type connection to the mating components.

The connector 70 is mounted to a bulkhead panel 88 in similar fashion as the above-described embodiment, with the end face 90 of a relatively larger diameter portion 92 of the connector shell 72 being drawn into abutment against the panel 88 by means of a nut 94 cooperating with a threaded body 96 of the connector shell 72. A suitable gasket 106 is provided to seal the bulkhead opening 109 through which the connector passes.

The connector shell 72 is of two part construction, in which halves 98 and 100 are induction soldered together, with a soldering preform 102 disposed in a recess 104. Each contact 74 passes through an opening 108 formed in an electrically insulating PC board 110, provided with a conductive pattern establishing an electrical connection between each of the contacts 74 and a respective circuit protection device 112 (only one of which being shown in FIG. 2 for the sake of clarity). The circuit protection devices 112 are disposed radially outward from the array of contacts 74, which are concentrated in the central area of the connector 70. Each contact 74 is connected to the PC pattern by means of a suitable soldered connection 114.

Each of the circuit protection devices 112 is provided with a lead 116, which extends through bore 115, with a suitable soldered connection 118 to the outer surface of the PC board 110.

Thus, each of the contacts 74 is soldered to be electrically connected to a particular one of the circuit protection devices 112.

Each contact 74 extends through an insert disc 122, with protuberances 123 insulating the same from a ground plate 128.

Each of the circuit protection devices 112 is also provided with an oppositely extending lead 120 which passes through the insert disc 122, having suitable openings 124. For this purpose, each lead 120 protrudes into a respective one of an array of holes 126 formed in the ground plate 128. A solder preform 130 provides a mechanical-electrical connection to the respective leads 120. A grounding foil 129 insures a good electrical contact to the interior face 132 of the shell 72.

The interposed spaces 134 and 136 are filled with suitable epoxy pellet adhesive or other such material.

Accordingly, it can be seen that this particular arrangement affords the array of circuit protection devices to be placed radially outward from the particular contact to which it is associated. While this increases the diameter of the connector, it still affords a relatively compact mounting with the aforementioned advantages of providing a heat sink in the form of the ground plate 128 while still maintaining short lead lengths to minimize the effects of self-inductance.

It may be understood that the circuit protecting devices themselves are quite small and the main bulk represented in the installation shown in FIGS. 1 and 2 is accounted for by the packaging of the "Transzorb" devices with external connections in a form ready for installation. In this form, they are much easier to handle during the manufacture of the connector. However, this configuration increases the bulk and to a degree the lead length of the connections thereto. Accordingly, it is preferable from a performance standpoint to install unpackaged diode devices directly into the connector.

FIG. 3 shows such an arrangement, in which an electrical connector 140 is depicted in fragmentary form including a connector shell 142 housing an array of connector contacts 144.

Each contact 144 may include a conventional RF filter grounding electrode 146 and includes a pin section 148 passing through a conductive ground plate 150 with suitable insulating spacers 153 providing an electrical insulation between the contact 148 and the ground plate 150. The pin contacts 148 also pass through a supporting insert disc 152 constructed of suitable insulating plastic such as PCB, but, as seen in FIG. 4, has an electrical foil connector 154 mounted thereto which is soldered at 155 to be in electrically connected to the pin contact 148 and which extends to one side of the diode 156 via a solder "bump" suitably connecting to one side of the protective diode 156.

The ground plate 150 is also provided with a solder bump 160 connecting to the opposite side of the diode 156. The ground plate 150 in turn is also connected electrically and mechanically to the connector shell 142 by solder joint 157 to thus establish an electrical connection from each pin 148 to one side of its protective diode 156, with the other side thereof connected to the connector shell 142 through the ground plate 150.

FIG. 5 shows that as an alternative to the use of solder to connect the diode 156, nailhead type terminals may be employed, in which a nailhead terminal 162 is mounted and carried by the ground plate 150 and electrically connected thereto by means of solder joint 164. The insert disc 152 also mounts a terminal 166 to each of the nail head connectors is in contact with opposite sides of the diode 156. Contact 148 extends through both in similar fashion with a spacer 153 providing electrical insulation. The pin contact 148 also passes through the support disc 152 and with a suitable foil tab 170 extending over the nailhead terminal 166 and soldered thereto.

Accordingly, this provides a much more compact arrangement which further shortens the lead lengths and further enhances the heat dissipating characteristics of mounting to the ground plate 150.

It should be appreciated that the present invention alleviates many of the disadvantages of the prior art in that minimum response time of the device is enabled for maximum circuit protection minimizing the lead length and self-inductance problem described. It can be seen that the present invention alleviates many of the disadvantages of the prior art in that the circuit protection is provided at the point most remote from the circuit which is to be protected to minimize the lead length self-inductance phenomenon described above.

To further minimize the response time of the devices, the direct contact of the diode 156 with a ground plate also further enhances the ability of these devices to dissipate heavy current surges, due to the rapid dissipation of heat.

The particular arrangement of mounting these devices within the connector itself produce a relatively compact package.

It will of course be appreciated that many variations in the specifics described are possible within the scope of the present invention such as the substitution of other protective devices for the "Transzorb" type devices which have suitable operating characteristics.

Also, the devices can be used in conjunction with conventional circuit protection devices such as the RF filter elements which have been previously been employed in electrical connectors, to suppress RF "hash" that could occur during or just prior to chip conduction by the electromagnetic pulse absorber device. The connector could also be used in conjunction with spark gap type surge arresters which are capable of suppressing very large electrical currents but with response times that are too slow to prevent circuit failures. The electromagnetic pulse absorber device can be used in conjunction therewith in order to ground out the current surge to protect the circuit until the spark gap device fires.

Having described the invention what is claimed is:

1. An electrical connector with a built in circuit protection device said connector of the type having a conductive connector shell and at least one contact mounted within such shell for mating with a corresponding electrical connector, a circuit protection device mounted within said connector shell, means electrically connecting said protection device to said contact and to a ground plate connected to said shell to thereby provide a grounding of said contact upon development of a predetermined voltage on said contact, said contact extending through said ground plate and an insulating spacer providing electrical insulation of said contact from said grounding plate, said circuit protection device having one and another side; a pair of connections electrically connected to said one and the other side of said circuit protection device, one side of said circuit protection device electrically connected to said ground plate by a soldered connection; one of said connections further including an insert disc mounted in said shell axially spaced from said ground plate, and wherein said contact extends through said insert disc with an electrical connection comprised of a soldered joint to connect said contact to said other side of said circuit protection device: characterized by said ground plate being positioned against and soldered to said connector shell to thereby minimize the self inductance impedance thereof, and to enhance the heat sink capacity of said ground plate.

2. The electrical connector according to claim 1 wherein said pair of connections comprise a pair of axially opposed leads, one electrically connected to a respective one and the other side of said circuit protection device, one of said leads extending into an opening formed in said ground plate and the other lead extending into an opening formed in said insert disc and each soldered to form electrical connections thereto.

3. The electrical connector according to claim 2 wherein said circuit protection device is disposed immediately adjacent to said contact extending parallel thereto within said connector shell.

4. The electrical connector according to claim 3 wherein said electrical connector includes a plurality of contacts and a corresponding plurality of circuit protection devices and wherein said insert disc is provided with a printed circuit, and wherein each of said circuit protection devices is mounted between said ground plate and said insert disc radially outwardly spaced from said plurality of contacts, and wherein said printed circuit provides an electrical connection between a respective one of said plurality of contacts and one side of said circuit protection devices.

5. The electrical connector according to claim 1 wherein said circuit protection device comprises a solid state diode directly mounted between and in contact with said ground plate and said insert disc.

6. The electrical connector according to claim 5 wherein said pair of electrical connections comprises a solder bump on said ground plate and a solder bump on the adjacent surface of said insert disc and means creating an electrical connection between said solder bump on said adjacent surface and said connector contact.

7. The electrical connector according to claim 5 wherein said pair of electrical connections comprises a pair of opposed nailhead terminals one received within said ground plate and the other of said nailhead terminals extending into said insert disc with each of nailhead terminals having headed portions positioned in opposition to each other with a space therebetween, with said diode mounted therebetween; further including means creating electrical connection between said nailhead terminal carried by said insert disc and said pin contact.

* * * * *